US006150036A

United States Patent [19]

Lubar

[11] Patent Number: 6,150,036

[45] Date of Patent: Nov. 21, 2000

[54] UNIVERSAL INK JET DRAFTING FILM

[75] Inventor: Michael J. Lubar, Endicott, N.Y.

[73] Assignee: Azon Corporation, Johnson City, N.Y.

[21] Appl. No.: 08/889,869

[22] Filed: Jul. 8, 1997

Related U.S. Application Data

[60] Provisional application No. 60/021,321, Jul. 8, 1996.

[51] Int. Cl.[7] ..... B41M 5/00

[52] U.S. Cl. ..... 428/500; 428/195; 428/216

[58] Field of Search ..... 428/195, 478.2, 428/500, 521, 522, 212, 213, 216

[56] References Cited

U.S. PATENT DOCUMENTS

| | | | |
|---|---|---|---|
| 4,775,594 | 10/1988 | Desjarlais | 428/421 |
| 4,887,097 | 12/1989 | Akiya et al. | 346/135 |
| 4,892,787 | 1/1990 | Kruse et al. | 428/331 |
| 4,935,307 | 6/1990 | Iqbal et al. | 428/500 |
| 4,954,395 | 9/1990 | Hasegawa et al. | 428/318.4 |
| 5,190,805 | 3/1993 | Atherton et al. | 428/195 |
| 5,206,071 | 4/1993 | Atherton et al. . | |
| 5,213,873 | 5/1993 | Yasuda et al. | 428/195 |
| 5,352,503 | 10/1994 | Drake et al. | 428/195 |
| 5,364,703 | 11/1994 | Idei et al. | 428/423 |
| 5,672,424 | 9/1997 | Malhotra et al. | 428/325 |
| 5,747,148 | 5/1998 | Warner . | |
| 5,789,070 | 8/1998 | Shaw-Klein et al. | 428/216 |

*Primary Examiner*—Pamela R. Schwartz
*Attorney, Agent, or Firm*—Gifford, Krass, Groh, Sprinkle, Anderson & Citkowski, P.C.

[57] ABSTRACT

A universal medium for ink jet printing comprises an ink receptor layer formed from a hydrophilic polymer and having a thin top coating of a cationic polymer. The medium can be used with pigment and dye based inks having either aqueous or glycol based solvents systems.

7 Claims, No Drawings

UNIVERSAL INK JET DRAFTING FILM

RELATED APPLICATION

This application claims the benefit of U.S. Provisional Application No: 60/021,321 filed Jul. 8, 1996, now abandoned.

FIELD OF THE INVENTION

This invention relates generally to ink receptive media for use in an ink jet imaging process. More specifically, the invention relates to a universal drafting film which can be employed with various ink jet imaging equipment and inks, and which provides a surface which can also be written on by a drafting pencil, pen, plotter and the like.

BACKGROUND OF THE INVENTION

In an ink jet imaging process, controlled amounts of one or more fluid ink are delivered to a receptor sheet in a preselected pattern so as to form an image thereupon. In a color imaging process three or more colored inks, and optionally a black pigmented ink are delivered to a receptor sheet by a plurality of separately controlled nozzles. In a number of instances, ink jet imaging is carried out on a receptor sheet which simply comprises a sheet of paper; however, in other instances, it is necessary to carry out ink jet imaging on receptor sheets which comprise coated substrates, and such substrates may comprise paper or polymeric materials. In particular drafting applications, it is necessary that an ink jet image receptor sheet be capable of also being drawn on by a drafting pencil, a pen or a mechanical plotter. It is also desirable that the substrate in such instances comprise a dimensionally stable body of material such as a sheet of polymeric material. The object in providing an ink jet imaging medium suitable for drafting is to provide a medium which, in addition to fulfilling physical requirements such as dimensional stability and transparency, is also capable of receiving both an ink jet image as well as providing a surface which can be drawn upon. Toward that end, a number of formulations have been developed in the prior art.

Ink jet imaging technology has undergone a number of changes, and as a result, an image receptor medium suitable for one generation of imaging process may not be suitable for another. For example, the first generation of ink jet imaging systems employed colored inks which were water based solutions of dyes. These inks were typically applied to the receptor medium from a relatively small number of nozzles. A second generation of ink jet technology employed glycol based solutions of dyes which were also applied to the medium from a relatively small number of nozzles. A third generation of ink jet systems employs water based dispersions of colored pigments which are typically applied from a large number of nozzles. In addition, all of the foregoing systems may or may not employ one or more nozzles for the purpose of dispensing a black pigmented ink. The problem presented is to provide a drafting medium which can work with all three ink jet imaging systems.

A first approach implemented by the prior art was to provide a medium which comprised a substrate having an ink jet ink receptor layer thereupon. The receptor layer comprised a hydrophilic polymer having relatively low water solubility. Typically, such polymers comprise an acrylic resin having a relatively large number of water soluble side chains graft polymerized thereonto. A number of the side chains are cross linked so as to decrease the water solubility of the resultant polymer. This medium has been found to give good image quality for ink jet systems of the first and second generation, namely those employing water or glycol based dye solutions; however, this medium provides very poor color density when utilized in conjunction with the pigment based inks of the third generation. In such instance, image spread of the applied third generation ink is very low; consequently, resultant color density of the image is low.

In a second approach taken by the prior art, a polyelectrolyte material such as polyvinyl pyrrolidone is added to the acrylic based graft polymer previously described. The addition of the polyelectrolyte gives a medium which provides good imaging results with the first and third generation systems, but has low image spread and color density for the glycol/dye inks of the second generation systems.

All of the above-described ink systems are currently employed; thus, it will be appreciated that there is a need for an ink jet imaging medium which provides good results when employed in connection with any of the foregoing ink jet systems. In addition, the medium must be capable of providing a surface which can be marked by other drafting materials such as pencils, pens and plotters. Furthermore, the medium should be relatively easy to prepare and have long term stability. As will be described in detail hereinbelow, the present invention provides an ink jet imaging medium which can be utilized with pigment based and dye based inks having both water and glycol solvents. The medium of the present invention is simple to prepare, stable and low in cost, and provides superior drafting medium. These and other advantages of the present invention will be utterly apparent to those of skill in the art from the discussion, description and examples presented herein.

BRIEF DESCRIPTION OF THE INVENTION

There is disclosed herein an ink receptive medium for use with an ink jet printer. The medium comprises a substrate having an ink receptor layer supported thereupon. The receptor layer comprises a hydrophilic polymer. A top coat layer is disposed upon the ink receptor layer, and the top coat layer comprises a cationic polymer. In some instances, the hydrophilic polymer may comprise an acrylic polymer having water soluble side chains graft polymerized thereonto, and the side chains may be cross-linked so as to decrease the water solubility of the hydrophilic polymer. The ink receptor layer may further include a polyelectrolyte therein.

In particular embodiments, the cationic polymer comprises a cationic starch, and this starch may be cross-linked by a cyclic imide or the like. In other instances, the cationic polymer may comprise styrene maleic anhydride in which a portion of the anhydride rings are open. The ink receptor layer may have a thickness in the range of 0.1–1 mil, and the top coat layer preferably has a thickness of no more than 1 micron.

DETAILED DESCRIPTION OF THE INVENTION

The present invention comprises a universal ink jet drafting medium which may be utilized in connection with both pigment and dye based inks having water and/or glycol solvents. In accord with the present invention, the universal, ink jet drafting medium may be prepared on a variety of substrates by first disposing an ink receptor layer thereupon, which receptor layer comprises a hydrophilic polymer, and by then disposing a top coat upon the receptor layer; which top coat comprises a cationic polymer.

The hydrophilic polymer comprises a polymeric material having a high affinity for water, glycols, alcohols and other polar solvents. Preferably, the polymer comprising the receptor layer will have a limited solubility in the solvent of the ink. Some hydrophilic polymers comprise: Polyvinylpyrrolidone, cellulose, modified cellulose, polyvinyl alcohol, polyvinyl acetate, polystyrene, and gelatin. In one preferred embodiment of the invention, the ink receptor layer comprises a cross-linked graft co-polymer Most specifically, the layer comprises an acrylic polymer having water soluble side chains grafted thereonto. The receptor layer will also preferably further include a polyelectrolyte. As is known in the art, polyelectrolytes comprise polymers which contain ionic substituents. One particularly preferred polyelectrolyte comprises polyvinylpyrrolidone (PVP)

One particularly preferred material for the ink receptor layer comprises a comb graft co-polymer which is combined with a polyelectrolyte. One specific comb graft co-polymer comprises a material sold by the Soken Corporation of Japan and is available through the Esperit Chemical Company of Florida. This particular comb graft co-polymer has an average molecular weight of 35,000 and includes a methyl methacrylate backbone which constitutes 78% of the polymer. Side chains of 2-hydroxyethyl methacrylate depend from the backbone and constitute 22% of the polymer. The comb graft polymer is water insoluble but hydrophilic, and it is combined with a water soluble polymer to produce a hydrogel. In general, the water soluble polymer will be present in a smaller amount than the comb graft co-polymer, and the water soluble polymer preferably comprises the polyelectrolyte PVP. In one specific embodiment, the receptor layer comprises, on a dry weight basis, approximately 64% of the comb graft co-polymer and approximately 36% PVP, all percentages being given in this disclosure on the basis of weight percentages. The receptor layer may further include pigments, fillers and the like as is known in the art.

The top coat of the medium of the present invention is comprised of a cationic polymer, which within the context of this disclosure comprises a polymer having positive charge centers thereupon. One preferred cationic polymer is cationic starch. This is a type of modified starch which results from the addition of positive charge centers such as amino groups thereto. The cationic starch may be cross-linked to further increase its viscosity by the use of cross-linking materials such as cyclic imides and the like. In another preferred embodiment, the cationic polymer may comprise a styrene maleic anhydride polymer of the type in which some of the anhydride rings are opened as to provide cationic centers, which may be acid and/or ester groups.

It has further been found that merely employing a water soluble, or hydrophilic polymer as a top coat does not obtain the advantages of the present invention if that polymer is not cationic. For example, non-cationic starch and polystyrene were both found to be ineffective.

It has been found that the top coating of the present invention provides for a good dot spread in the glycol-dye system of the second generation, and also maintains a good response for the first and third systems. Specifically, it has been found that the color density of the image made, utilizing the second generation ink system, is at least 25% greater when the top coat of the present invention is present. This is a surprising finding since, as will be detailed herein below, the top coat of the present invention comprises a relatively thin layer.

In accord with the present invention, the substrate may comprise paper or polymeric stock of any thickness, and may include subbing layers, adhesive layers, and the like. The receptor layer is typically present at a thickness in the range of 0.1–1 mil. In a specific embodiment, the thickness of this layer is approximately 0.4 mil. The top coating of the present invention is preferably applied in a very thin layer, typically at a sub micron thickness.

The layers of the present invention may be coated utilizing standard coating technology. The ink receptor layer is typically applied by those techniques utilized in the prior art to prepare such media, and as such may be coated by a wire bar coater, a doctor blade coater or the like. The thin layer of the top coating of the present invention may be applied by any technique which will deposit a thin layer and which will not disrupt underlying coating. In one particularly preferred method, a relatively thin layer of top coat material is flowed out onto a substrate which was previously coated with the receptor layer, and this coating is doctored by an air knife. In this manner, damage to the underlying layer is prevented. In other embodiments of the invention, the top coating may be applied by spraying, extrusion coating or the like.

In one specific embodiment of the present invention, the substrate is a commercially available polyester which is then coated with a subbing layer that promotes adhesion of subsequent layers thereto. A 0.35 mil coating of acrylic polymer having a relatively high loading of silica pigment is applied to the substrate by wire bar coating from a solvent solution and allowed to dry. A 0.35 mil coating of the hydrophilic receptor material is then applied by wire bar coating an organic solvent solution of a material sold by Allied Colloids under the designation SP-6. This polymer comprises an acrylic backbone with side chains containing acid groupings, hydroxyl groups and optionally acrylamide groups. The top coat in this instance comprises a cationic starch, cross linked with a cyclic imide, and sold under the designation Sunrez by Sequa Chemicals of South Carolina. The top coat is applied from a solvent solution by the afore-described air knife technique, at a thickness of less than a micron.

The foregoing discussion and description are illustrative of particular embodiments of the present invention, but are not meant to be limitations on the practice thereof. Other skill in the art in view of the teaching presently herein. Therefore, it is the following claims, including all equivalents, which define the scope of the present invention.

What is claimed is:

1. An ink receptive medium for an ink jet printer, said medium comprising:

a substrate;

an ink receptor layer supported on said substrate, said receptor layer comprising a hydrophilic polymer; and a top coat layer disposed upon said ink receptor layer, said top coat comprising styrene maleic anhydride wherein a portion of the anhydride rings are opened.

2. A medium as in claim 1 wherein said hydrophilic polymer comprises an acrylic polymer having water soluble side chains graft polymerized thereonto.

3. A medium as in claim 2 wherein a portion of said water soluble side chains are cross linked so as to decrease the water solubility of said hydrophilic polymer.

4. A medium as in claim 1, wherein said ink receptor layer further includes a polyelectrolyte material therein.

5. A medium as in claim 4, wherein said polyelectrolyte comprises polyvinyl pyrrolidone.

6. A medium as in claim 1, wherein the ink receptor layer has a thickness in the range 0.1–1 mil.

7. A medium as in claim 1, wherein the top coat layer has a thickness which is less than one micron.

* * * * *